US006951236B2

(12) United States Patent
Schlater et al.

(10) Patent No.: US 6,951,236 B2
(45) Date of Patent: Oct. 4, 2005

(54) RETENTION SYSTEM FOR PIVOTALLY CONNECTED SHUTTER SLATS

(75) Inventors: Timothy J. Schlater, Ludlow Falls, OH (US); Brian A. Wenrick, New Carlisle, OH (US); Jason D. Wenrick, Tipp City, OH (US); Jack D. Young, Dayton, OH (US)

(73) Assignee: Creative Extruded Products, Inc., Tipp City, OH (US)

( * ) Notice: Subject to any disclaimer, the term of this patent is extended or adjusted under 35 U.S.C. 154(b) by 0 days.

(21) Appl. No.: 10/959,445

(22) Filed: Oct. 5, 2004

(65) Prior Publication Data

US 2005/0045280 A1 Mar. 3, 2005

Related U.S. Application Data

(63) Continuation of application No. 10/403,201, filed on Mar. 31, 2003, now abandoned.

(51) Int. Cl.[7] ..... E06B 9/08
(52) U.S. Cl. ..... 160/133; 160/201; 160/236
(58) Field of Search ..... 160/133, 229.1, 160/233, 235, 236, 201

(56) References Cited

U.S. PATENT DOCUMENTS

| | | | | | |
|---|---|---|---|---|---|
| 1,367,240 | A | * | 2/1921 | Cornell | 160/235 |
| 4,160,343 | A | * | 7/1979 | Hubbard | 49/90.1 |
| 4,493,356 | A | | 1/1985 | Hermann et al. | |
| 4,601,953 | A | | 7/1986 | Haffer | |
| 4,715,421 | A | | 12/1987 | Erber | |
| 4,723,588 | A | * | 2/1988 | Ruppel | 160/236 |
| 4,972,894 | A | | 11/1990 | Machill | |
| 5,204,147 | A | | 4/1993 | Schneider | |
| 5,253,694 | A | | 10/1993 | Bernardo | |
| 5,303,507 | A | | 4/1994 | Oille | |
| 5,411,782 | A | | 5/1995 | Jarvis et al. | |
| 5,474,118 | A | | 12/1995 | Hoffman | |
| 5,566,738 | A | | 10/1996 | Yadidya | |
| 5,611,383 | A | | 3/1997 | Hoffman | |
| 5,682,937 | A | * | 11/1997 | Decrane et al. | 160/133 |
| 5,722,476 | A | * | 3/1998 | Lujan-Sanchez et al. | 160/133 |
| 5,839,493 | A | | 11/1998 | Quasius | |
| 5,996,669 | A | | 12/1999 | Miller | |
| 6,006,815 | A | | 12/1999 | Schanz | |
| 6,095,225 | A | | 8/2000 | Miller | |
| 6,371,189 | B1 | * | 4/2002 | Azoulai | 160/133 |
| 2003/0024659 | A1 | | 2/2003 | Begni | |
| 2003/0041978 | A1 | | 3/2003 | Farooq | |
| 2004/0003903 | A1 | | 1/2004 | Wenrick et al. | |

FOREIGN PATENT DOCUMENTS

| | | | | |
|---|---|---|---|---|
| DE | 3043480 | | 5/1982 | |
| DE | 29906134 | * | 8/2000 | 160/133 |
| JP | 4224656 | * | 2/1994 | 160/133 |
| WO | WO 87/03641 | | 6/1987 | |

* cited by examiner

*Primary Examiner*—Bruce A. Lev
(74) *Attorney, Agent, or Firm*—Jacox, Meckstroth & Jenkins

(57) ABSTRACT

A plurality of elongated shutter slats of extruded rigid plastics material have co-extruded cores of rigid plastics foam material, and injection molded plastic end caps are attached to opposite ends of each slat. The end caps have elongated flat base portions and retention lugs with head portions integrally connected to the base portion by reduced neck portions. The lugs of the end caps are retained within undercut channels in extruded metal side rails. In one embodiment, each end cap is secured to a slat by screws extending through two retention lugs and into the foam core. In another embodiment, the end caps are secured to hollow slats by integrally molded bosses which project into cavities within hollow slats and are cemented to the walls of the slat.

2 Claims, 2 Drawing Sheets

RETENTION SYSTEM FOR PIVOTALLY CONNECTED SHUTTER SLATS

This is a continuation of application Ser. No. 10/403,201, filed Mar. 31, 2003, now abandoned.

BACKGROUND OF THE INVENTION

This invention relates to the retention and support of pivotally connected slats forming a roll-up shutter such as a hurricane or storm shutter and of the general type disclosed in U.S. Pat. No. 5,839,493, the disclosure of which is herein incorporated by reference. The storm shutter slats are commonly made from an aluminum extrusion or an extrusion of rigid plastics material such as rigid polyvinylchloride (PVC), and each slat includes inner and outer arcuate side walls which are integrally connected by longitudinally extending internal webs and longitudinally extending edge walls. The opposite edge walls of each slat commonly form a longitudinally extending hook portion and an undercut cavity or recess which form pivotal connections between adjacent slats so that the connected slats may be rolled up into a coil as shown in the above '493 patent. Other forms of shutter slats and retention systems are disclosed in U.S. Pat. Nos. 5,253,694, 5,996,669, and published PCT patent application No. WO87/03641.

With any shutter assembly such as disclosed in the above mentioned patents, the opposite end portions of the pivotally connected horizontal slats are connected to and retained by generally vertical elongated metal side rails which are usually mounted on the window or door frame and guide the horizontal slats during vertical movement between the rolled-up retracted position and the lower extended and window covering position. With any such support and guide system for the slats, it has been found desirable to provide a high strength connection between each slat and the metal or aluminum side rails while also providing for smooth and low friction movement of the slats without producing wear of the side rails or the retention system. When a storm shutter is used for resisting very high or hurricane wind forces and/or very high impacts, it is also desirable for the slat retention system not to damage the side rails or slats or retention system while resisting the wind forces or impacts. If the side rails or retention system are damaged, the shutter system will no longer move or slide smoothly between its open and closed positions with minimal effort. Thus it is desirable to have a high strength slat support retention and guide system which avoids metal on metal contact and protects the slats, side rails and retention system under all conditions.

SUMMARY OF THE INVENTION

In accordance with a preferred embodiment of the invention, a storm shutter and retention system includes a plurality of elongated slats which are formed from an extrusion of substantially rigid plastics material such as rigid polyvinylchloride (PVC). Each slat has opposite side walls which are integrally connected by longitudinally extending transverse walls to define a plurality of the internal cavities or chambers. The transverse walls include internal webs and opposite edge walls which extend to form a longitudinally extending integral hook portion and a longitudinally extending undercut recess for pivotally connecting each slat to adjacent slats. In one embodiment, each slat has a core of rigid plastics foam material which is co-extruded with the walls of the slat so that the core material adheres or bonds to the inner surfaces of the walls and has a uniform density along the length of the slat.

A pair or set of end caps of rigid molded plastics material are secured to opposite end portions of each slat, and each end cap includes a base portion overlying the end surface of the slat and one or two retention lugs each having a head portion integrally connected to the base portion by a reduced neck portion. The retention lugs project into longitudinally extending undercut chambers formed within elongated vertical side rails which support and guide opposite end portions of the connected slats for movement between an upper retracted position and an extended lower closed position. In the one embodiment, the end caps are secured to the corresponding end portions of a slat by self-tapping screws which extend through the retention lugs and are threaded into the foam core of the slat. In a modified embodiment, each end cap is secured to the corresponding end portion of the slat by a set of bosses which are molded as an integral part of the end cap. The bosses project into the internal chambers of the slat and are bonded by adhesive to the walls of the slat. The end caps also limit relative longitudinal movement between adjacent slats.

Other features and advantages of the invention will be apparent from the following description, the accompanying drawings and the appended claims.

DESCRIPTION OF THE PREFERRED EMBODIMENTS

Figure 1:
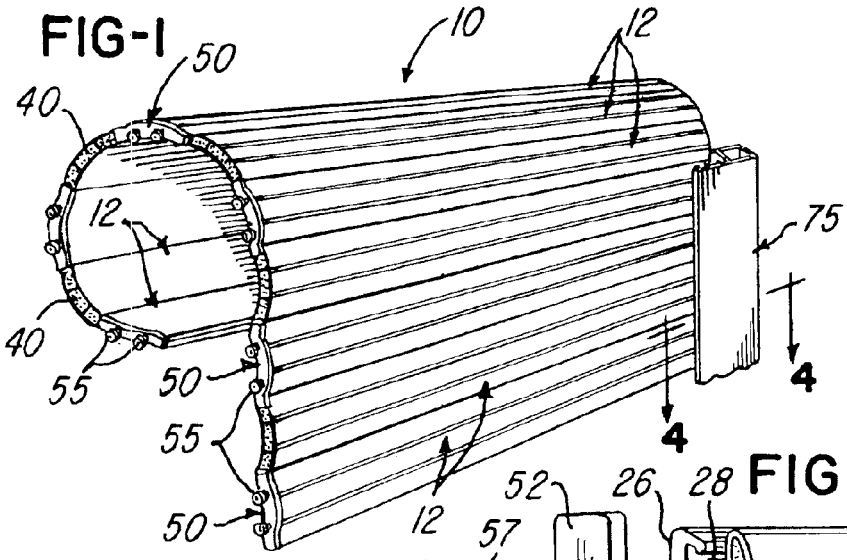
FIG. 1 is a perspective view of an assembled storm shutter which is supported, retained and guided by a retention system constructed in accordance with invention.

FIG. 1 illustrates a storm shutter assembly 10 of the roll up type and formed by a plurality of articulated or pivotally connected elongated shutter slats 12 formed from an extrusion of substantially rigid plastics material such as rigid polyvinylchloride (PVC). Each extruded slat 12 includes a slightly arcuate outer side wall 14 and a slightly arcuate inner side wall 16 which are integrally connected by transverse walls including transverse webs or inner walls 18 and transverse longitudinally extending edge walls 22 and 23. An integral hook portion or member 26 projects laterally from the J-shaped edge wall 22 and cooperates with the edge wall 22 to define a longitudinally extending undercut recess 28. Another integral hook portion or member 32 projects from the opposite edge wall 23, and both of the hook portions 26 and 32 have a thickness greater than the thickness of the side walls 14 and 16 and the edge walls 22 and 23.

Figure 2:
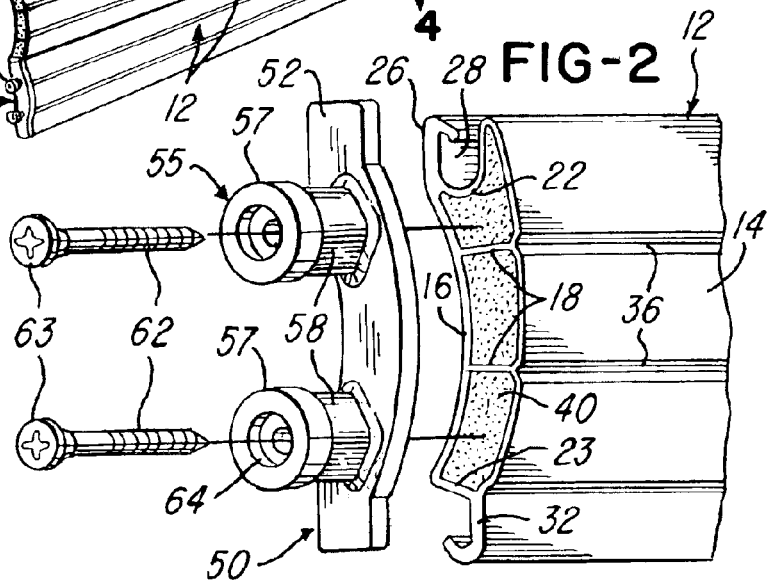
FIG. 2 is a fragmentary exploded view of a shutter slat and retention end cap as shown in FIG. 1 and constructed in accordance with one embodiment of the invention.

The hook portion 32 of each slat 12 is adapted to hook into and be received by the undercut recess 28 of an adjacent slat 12, either by an articulated hooking action or a longitudinally telescoping action. As shown in FIGS. 1 and 2, the outer side wall 14 is extruded with a plurality of longitudinally extending V-shaped grooves 36 which are longitudinally aligned with the corresponding internal transverse walls or webs 18. The grooves 36 provide a decorative appearance to the outer side surface 14 and avoiding any sink marks due to the webs 18 having a thickness substantially the thickness of the side walls 14 and 16.

The slat 12 has a core 40 of substantially rigid foam material, such as rigid PVC foam, and the foam material is co-extruded with the extrusion of the slat 12. As a result of the co-extrusion, the foam core 40, which has a uniform density substantially lower than the density of the body of the slat 12, adheres or bonds to the inner surfaces of the slat body and fills all of the cavities or chambers on opposite sides of the webs 18. Preferably, the rigid foam core 40 has a density of about 40 pounds per square foot and the rigid plastic extruded slat 12 has a density of about 90 pounds per cubic foot.

As a result of the rigid co-extruded foam core 40 and the adhesion or bonding of the core material to the inner surfaces of the slat body, the slat 12 has a bending strength which is substantially greater than the bending strength of the extruded rigid vinyl slat without the foam core 40. Thus the foam core provides for a high strength/weight ratio in addition to providing the side walls 14 and 16 with a high resistance to wind pressure or to denting from an impact. The slats 12 will also not corrode when exposed to salt water, and the rigid PVC material forming the slat may be compounded to provide a high resistance to ultra-violet rays. The foam core 40 also provides the slat 12 with significant thermal insulation which is desirable in some installations.

Figure 3:
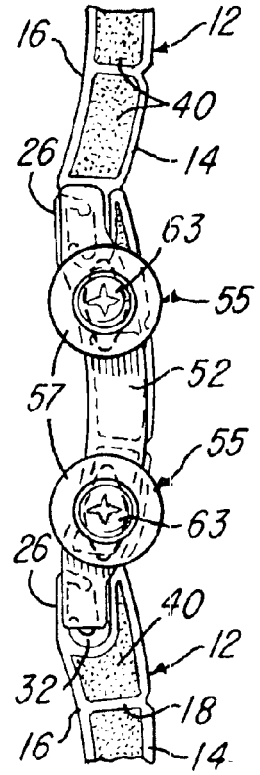
FIG. 3 is an enlarged fragmentary end view of the shutter assembly shown in FIG. 1.

Referring to FIGS. 2 and 3, the opposite end portions of alternate slats 12 in the assembly 10 are secured to corresponding end caps 50 which are injection molded of rigid plastics material such as rigid PVC or nylon. Each end cap 50 includes a generally flat and slightly arcuate base portion 52 which conforms generally to the arcuate profile of the slat 12, as shown in FIG. 3. The end portions of the base portion 52 overlay or cover the hook portions 26 and 32 and recess 28 of the corresponding slat 12. Each end cap 50 also includes a plurality or pair of integrally molded retention lugs 55 which have cylindrical head portions 57 integrally connected to the base portion 52 by a reduced neck portion 58 having a generally oval or marquis-shaped cross-sectional configuration, as shown in FIGS. 2 and 3. Each end cap 50 is positively secured to the end of the corresponding slat 12 by a pair of self-tapping stainless steel wood screws 62 each having a flat head portion 63 with a square or phillips recess. The head portion 63 of each screw 62 is confined within a counterbore 64 of the corresponding retention lug 55, and each screw 62 is threaded into the rigid foam material forming the core 40 within the corresponding slat 12.

Figure 4:
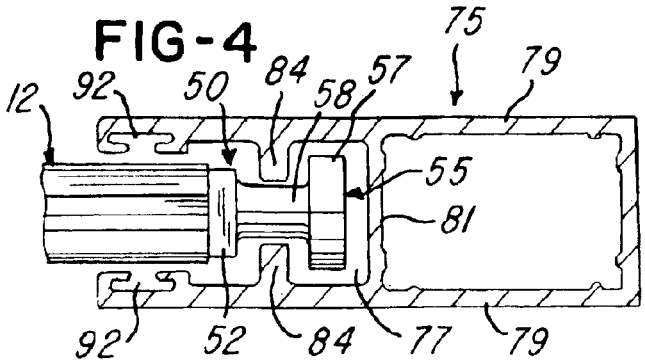
FIG. 4 is a fragmentary section taken generally on the line 4—4 FIG. 1.

Referring to FIGS. 1 and 4, the opposite end portions of the pivotally connected slats 12 are confined within and retained by a pair of vertical side rails 75 which are preferably extruded of aluminum and have an overall rectangular cross-sectional configuration. The side rails 75 are similar in construction to the side rails disclosed in above-mentioned U.S. Pat. No. 5,839,493 and include a longitudinally extending undercut chamber 77 defined by opposite side walls 79, an internal connecting wall 81 and opposing inwardly projecting ribs 84. The undercut chamber 77 of each side rail 75 receives the head portions 57 of the retention lugs 55 of the end caps 50 of the assembled slats 12. The opposite end portions of the slats 12 are thereby retained by the side rails 75 for sliding movement with the end portions of the slats projecting between the side walls 79 of the side rails.

Figure 5:
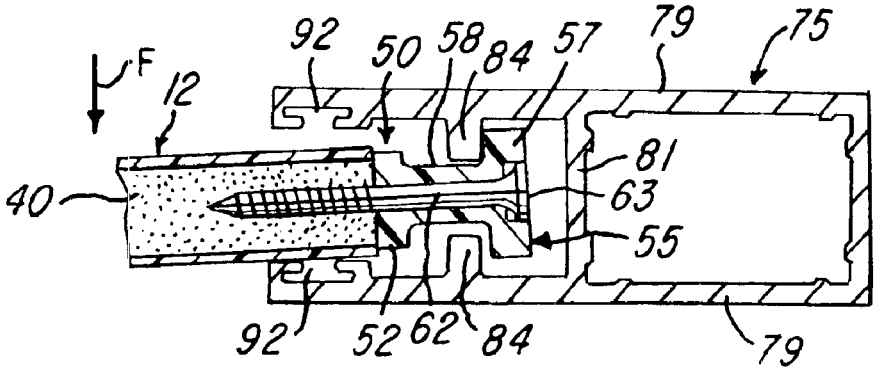
FIG. 5 is a fragmentary section similar to FIG. 4 and illustrating the position of a shutter slat relative to its corresponding retention side rail in response to a high wind load or impact.

After the shutter assembly 10 is moved from its upper rolled and retracted position to a downwardly extending position covering a window or door, it is possible for the connected slats 12 to bow in response to a substantial impact or wind force F, as shown in FIG. 5. The bowing of the slats 12 causes the end caps 50 to tilt within the side rails 75 until the head portions 57 of the retention lugs 55 engage the outer rib 84. The side walls 79 of each side rail 75 are provided with undercut grooves or slots 92 for receiving felt-type sealing strips (not shown), for example, as shown in the above-mentioned '493 patent.

Figure 6:
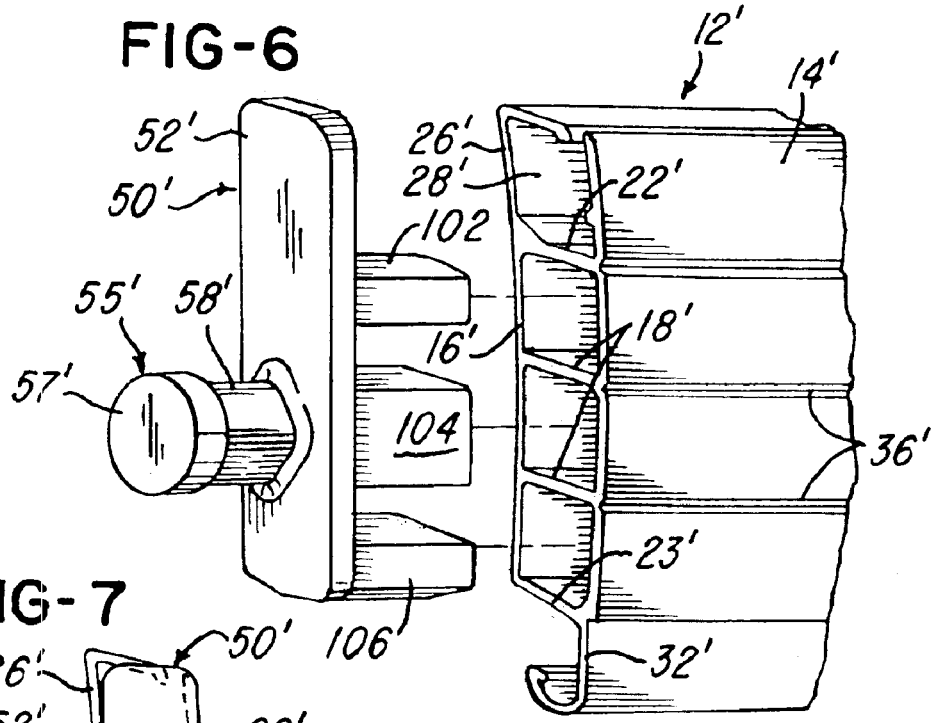
FIG. 6 is a an exploded view similar to FIG. 2 and showing another embodiment of the invention.
Figure 7:
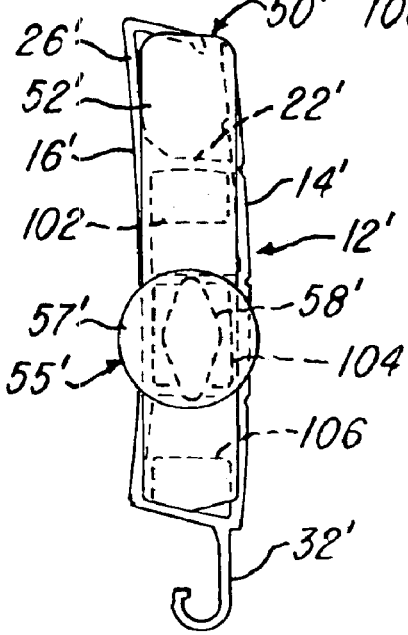
FIG. 7 is an end view of the assembled shutter slat and end cap shown in FIG. 6.

FIGS. 6 and 7 show another form of slat 12' which is constructed similar to the slat 12 described above and wherein all of the walls are identified by the same corresponding reference numbers but with the addition of prime marks. In this embodiment, each slat 12' is hollow and does not include the rigid foam core 40. A shutter assembly formed with pivotally connected slats 12' is preferably used as a sun shade or a light storm shutter. In this embodiment, each end cap 50' includes a generally rectangular and flat base portion 52' and a single retention lug 55' which has a cylindrical head portion 57' integrally connected to base portion 52' by a reduced neck portion 58' having a generally oval or marquis-shaped cross-sectional configuration. The end cap 50' also includes a plurality or three integrally molded lugs or bosses 102, 104 and 106 which project inwardly into the cavities or chambers defined by the walls 14', 16', and 18' of the slat 12'. The bosses are bonded to the walls by a suitable cement or adhesive such as a PVC primer and a PVC adhesive.

The one-piece injection molded end caps 50' for the slats 12' are retained within the side rails 75 in the same manner as described above for the assembled slats 12. As also shown in FIG. 7, the base portion 52' of each end cap 50' overlies or covers the end of the chamber defined by the outer wall 14' and the hook portion 26' of the slat 12' in order to limit relative longitudinal movement between adjacent pivotally connected slats 12'. The base portion 52' of each slat 50' may also be cemented to the outer end surfaces of the walls 18' and 23' and hook portion 26' of the corresponding slat 12'. The generally rectangular shape of the base portion 52' of the end cap 50' permits the end cap to be used on both ends of the corresponding slat 12'.

From the drawings and the above description, it is apparent that a slat assembly and retention system constructed in accordance with the invention, provides desirable features and advantages. For example, the injection molded end cap 50 with its dual retention lugs 55 and its attachment to an end portion of a slat 12 by the screws 62, provides a high retention strength when received within the side rails 75. As a result, the shutter assembly 10 will withstand hurricane wind forces as well as high impact forces without damage to the slats or to the end caps or side rails. The end caps also distribute the loads or forces over a large effective area of the ends of the slats and help to absorb the energy from the impacts. The plastic end caps 50 and 50' also provide durable and wearable surfaces within the metal side rails 75 so that the shutter assembly provides an extended period of trouble-free use. In addition, the end caps 50 and 50' may be quickly and positively attached to the end portions of the slats 12 and 12', and the covering base portions 52 and 52' of the end caps are effective to limit relative longitudinal movement between adjacent slats 12 and 12'.

While the forms of shutter and retention system herein described constitute preferred embodiments of the invention, it is to be understood that the invention is not limited to these precise forms, and that changes may be made therein without departing from the scope and spirit of the invention as defined in the appended claims.

What is claimed is:

1. A shutter and retention system comprising a plurality of elongated one-piece shutter slats, each of said shutter slats comprising a one-piece extrusion of rigid plastics material, each of said slats having opposite end portions and including inner and outer opposite side walls integrally connected by longitudinally extending transverse walls to define a longitudinally extending internal cavity, a rigid core within said internal cavity of each said slat, said core comprising a co-extrusion of rigid plastics foam material, a longitudinally extending hook member and a longitudinally extending recess along opposite edges of each said slat for pivotally connecting each said slat to an adjacent said slat, a set of generally vertical elongated side rails extending adjacent said opposite end portions of said slats, a set of end caps of molded rigid plastics material for said opposite end portions of each said slat, each said end cap comprising a one-piece said end cap including a base portion overlying an end surface of said slat and a plurality of spaced retention lugs each having a head portion integrally connected to said base portion by a reduced neck portion to form said one-piece with said head portion larger than said neck portion, a plurality of screws extending through said retention lugs and the integrally connected said base portion of each said end cap, each said screw threaded into said rigid core of rigid plastics foam material to secure the corresponding said end cap to said slat, and each of said side rails having a longitudinally extending undercut vertical chamber receiving said head portions of said plurality of retention lugs of each said end cap.

2. A shutter and retention system as defined in claim 1 wherein said reduced neck portion of each said retention lug has a marquis-shaped cross-sectional configuration to assist guiding said retention lug within said chamber of said side rail.

* * * * *